US005681168A

United States Patent [19]

Brown

[11] Patent Number: 5,681,168

[45] Date of Patent: Oct. 28, 1997

[54] TETHERED BALL DEVICE HAVING CHAOTIC MOTION AND METHODS FOR TRAINING

[76] Inventor: Alton R. Brown, 4650 N. Washington Blvd., Apt. 606, Arlington, Va. 22201

[21] Appl. No.: 588,689

[22] Filed: Jan. 19, 1996

Related U.S. Application Data

[63] Continuation-in-part of Ser. No. 392,245, Feb. 22, 1995, abandoned.

[51] Int. Cl.[6] ..... G09B 19/16

[52] U.S. Cl. ..... 434/219; 434/258; 473/423; 482/87; 482/83

[58] Field of Search ..... 434/219, 29, 258, 434/302; 273/440, 447; 473/423, 422; 482/83, 87, 86

[56] References Cited

U.S. PATENT DOCUMENTS

| | | | |
|---|---|---|---|
| 1,694,044 | 12/1928 | Thompson | 482/83 |
| 2,307,905 | 1/1943 | Ament . | |
| 3,297,321 | 1/1967 | Kuhnes | 273/26 E |
| 3,483,302 | 12/1969 | Ashkenas et al. | 434/258 |
| 3,785,643 | 1/1974 | Rich | 273/413 |
| 3,861,679 | 1/1975 | Culpepper . | |
| 3,934,878 | 1/1976 | Haber | 273/413 |
| 4,077,624 | 3/1978 | Feaser | 482/87 |
| 4,088,316 | 5/1978 | Szafianski | 273/29 |
| 5,374,056 | 12/1994 | Scher | 273/26 E |

FOREIGN PATENT DOCUMENTS

| | | | |
|---|---|---|---|
| 536504 | 2/1977 | U.S.S.R. | 434/219 |
| 1081645 | 3/1984 | U.S.S.R. | 434/219 |

*Primary Examiner*—Jeffrey A. Smith
*Attorney, Agent, or Firm*—Alfred E. Smith

[57] ABSTRACT

The present invention is directed to a tethered ball training device that has an adjustable chaotic motion. The invention includes a supporting frame and a non-elastic line suspended from the frame. A resilient ball is mounted at the bottom end portion of the line and a weight slidably attached to the line is positioned in between the lower ball and the upper frame. In a method of training, a player first hits the tethered ball in a first direction of rotation. The ball will undergo chaotic motion as it rotates in this first direction. The player then tries to hit the ball to rotate it in the opposite direction and provide it with a different chaotic motion. This hitting of the ball is repeated. In a method of training a crane operator, a load is placed in motion and a trainee practices bringing the load under control.

5 Claims, 3 Drawing Sheets

TETHERED BALL DEVICE HAVING CHAOTIC MOTION AND METHODS FOR TRAINING

CROSS-REFERENCE TO RELATED APPLICATION

This application is a continuation-in-part of application Ser. No. 08/392,245, filed Feb. 22, 1995, now abandoned.

FIELD OF INVENTION

This invention relates in general to a device for amusement or for trainingusing the chaotic motion of an an object. In particular, this invention relates to a training device having a ball that is capable of chaotic motion when hit or otherwise placed into motion. For example, the training device is usable in training players of a racket game, such as tennis players or badminton players, in the development of a volley. The training device is also usable in training a crane operator in responding to chaotic motion of a load to bring the load under control.

DESCRIPTION OF THE PRIOR ART

There is always a need for good training devices in sports. However, in some sports, such as those that use a racket to hit a ball or other object (e.g. a badminton shuttlecock), there is a dearth of such devices. One such area that really needs to have an effective training device is the volley stoke of a racket player. It is important for such a training device not only to be able to produce improvements, but also to have a variable level of difficulty. In this way a novice will not resign in frustration should the training be too difficult and a more advanced player will not be frustrated because the device is too simple and not challenging enough. It is also desirable for such a device to have an variably increasing level of difficulty so that as a player masters one level, the difficulty can be increased.

One class of devices used to train players trying to hit a ball is the tethered ball device. Tethered ball devices usually employ a resilient ball connected to one end of a linear supporting means or line such as a string, elastic line, rope, chain, spring, and narrow strip of cloth. The line in turn is suspended from some vertical point. Sometimes more than one line is used to tether the ball. In addition to being a training instrument, a tethered ball device can also be a toy or amusement device. The prior an is replete with such training and amusement devices and many are found in the U.S. classification system in class 273, subclasses 26, 29 and 58.

Most of the prior art training devices do not employ components for inducing erratic motion, which is also called chaotic movement in the field of dynamics. This is probably because chaotic movement is usually not encountered during the sport and because incorporating chaotic movement in a training device is only now being appreciated. In fact, in many prior art devices, the inventors sought to design chaotic movement out of their training devices.

There are some amusement and training tethered ball devices that utilize or might allow a form of erratic motion. In such devices there are usually two bodies connected spaced apart to a line, but these bodies are separated by a fixed distance. Examples of such amusement and training devices are disclosed in the following U.S. patents, which are incorporated herein by reference:

U.S. Pat. Nos. 2,307,905; 3,785,643; 3,861,679; and 4,088,316.

For example, it appears that the device disclosed in U.S. Pat. No. 3,785,643 includes chaos as a feature. It appears that the object of the toy is to use erratic motion produced in the device as an amusing feature. This device incorporates two balls, separated by a fixed distance, tethered to the same string. When one ball is put into motion, both bails undergo erratic motion. However, this patent does not teach, and the toy design disclosed therein could not be used as, a means of systematically training the volley stroke or anything else because there is no means for controlling the level of chaos. That is, there is no way to slowly increase the level of chaos as a student improves his or her ability to volley a ball undergoing chaotic motion.

This point extends to other tethered ball devices that by accident may include the possibility of chaotic motion. For example, a ball tethered to a line composed of two different but fixed elastic lines may possibly produce chaos, but the chaotic motion cannot be introduced in a controlled systematic way that permits the student to learn to volley chaotic motion. In fact, the possibly of chaos in such devices may lead to their being quickly abandoned by their users.

Hence, if chaos is to be used in a training device, it must be introduced in a controlled systematic manner that starts with a non chaotic motion and slowly increases the level of chaos as the student masters each level.

SUMMARY OF THE INVENTION

Previous tethered ball training devices have failed to recognize the importance of the use of chaos in the training process. The advantages of using chaos in the training process have only recently become clear due to research in the field of neurodynamics. For example, it has been found that the use of chaos accelerates the learning process, increases concentration, appears to increase the visual processing chain and in particular the visual processing frame rate, raises the level of learning over conventional methods, and induces a state of heightened perception and awareness referred to by professionals as "being in the zone." All previous tethered ball training devices have failed to recognize, let alone make use of, this important feature.

The use of a volley training device according to the present invention has been found to result in extraordinary improvements in volleying ability. Thus, the advantage of the volley training device as a training device is that it is designed to control systematically and continuously the level of complexity of the motion of the ball so that motion can be varied from periodic to chaotic. As a consequence of the controlled systematic use of chaos, it has been found from experience that a volley training device according to the present invention:

1) accelerates the learning process;
2) rapidly increases concentration;
3) stimulates an increase in the visual processing frame rate, as suggested by subjects who report that the ball seems to slow down;
4) induces a level of learning that is far higher than can be obtained by present methods;
5) develops a superior volley faster and cheaper than other methods;
6) induces a state of increased perception and awareness described as "being in the zone" by professional tennis players; and
7) it appears that the volley training device may provide a means of learning, remembering, and recalling the "zone" state.

The chaotic motion theory behind the present invention is similar to the motion theory of the well known two dimensional double pendulum problem. It relies on the ability to predict an outward path of the bottom pendulum weight after being put into motion with an impulse vector of known direction and force, but the total inability to predict from such motion, the motion in any other direction. The effectiveness of a training device utilizing such a chaotic motion theory is based on a well known physiological theory that the natural state of a healthy brain is chaotic. Thus, it is believed that the success of any training devices will incorporate chaos in some systematic manner. The present invention utilizes the double pendulum dynamics in three dimensions as a means for producing a controllable, variable chaos.

In a presently preferred embodiment, the present invention is directed to a device connectable to an upper supporting surface and comprising an object to be struck or otherwise placed into motion, such as a resilient ball; and a means for suspending said object from the upper supporting surface, and for imparting a chaotic motion to said object when said object is placed into motion. Said suspending means comprises a substantially non-extensible, flexible line, such as a monofilament plastic string, and a weight positionably mounted on said line at a plurality of selectable locations between said upper supporting surface and said object.

Accordingly, one skilled in the art will appreciate that a volley training device according to the present invention provides a rapid and impressive means of developing a tennis volley. The training device provides a controllable and systematic use of chaos that can be continuously varied from periodic to very chaotic, and it can increase concentration of the user. Also, as suggested by experimental subjects, who have reported that the ball seems to slow down, the present invention can stimulate an increase in the visual processing frame rate and can provide a level of learning far higher than can be obtained by present methods. Thus, a training device in accordance with the present invention has developed a superior volley faster and cheaper than other methods. The training device also induces a mental state described by players as "being in the zone," during which their performance achieves an exceptionally high level in which the ball seems to slow down and their concentration is in a heightened state.

These and other advantages, objects and features will be described in, or be apparent from, the detailed description of the presently preferred embodiments set forth hereinbelow.

BRIEF DESCRIPTION OF THE PREFERRED EMBODIMENTS

Figure 1:
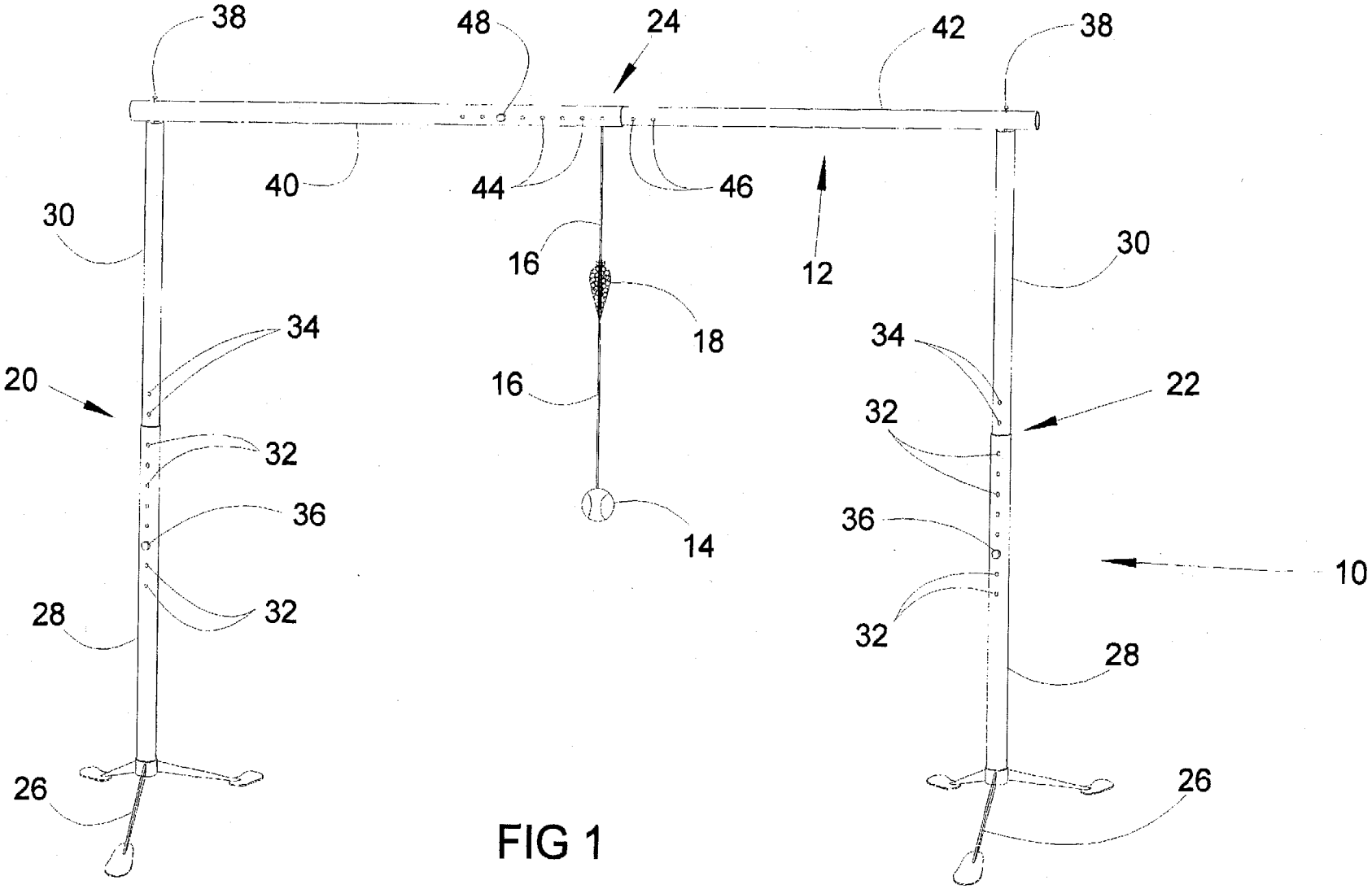
FIG. 1 is a front perspective view of a volley training device according to the present invention in which the device is set up for a less experienced player.

With reference now to the figures in which like numerals represent like elements throughout the several views, and in particular with reference to FIG. 1, a presently preferred embodiment of a training device 10 according to the present invention is illustrated. Training device 10 is comprised of a frame 12, a resilient ball 14, a line 16, and a weight 18 that is adjustably, slideably positionable on line 16 between frame 12 and ball 14.

Frame 12 must be of sufficient strength to enable the player to strike ball 14 with considerable force after which the ball must remain attached. As shown in FIG. 1, Frame 10 is comprised of two vertical stanchions 20 and 22 and a horizontal crossbar 24. Each stanchion 20 and 22 is in turn comprised of a base 26 at the bottom end, and a telescoping outer pole 28 and an inner pole 30. Poles 28 and 30 each have a plurality of respective holes 32 and 34 therein so that the vertical height of the respective stanchion can be adjusted. A locking bolt 36 extending through aligned holes 32 and 34 locks poles 28 and 30 at a given vertical height. Rigidly mounted at the top end of each stanchion 20 and 22 is an upwardly extending, locating pin 38. Crossbar 24, like stanchions 20 and 22, is comprised of an outer pole 40 and a telescoping inner pole 42. Crossbar poles 40 and 42 have a plurality of respective holes 44 and 46 so that the transverse length of crossbar can be adjusted. A locking bolt 48 extends through aligned holes 44 and 46 and locks poles 40 and 42 at a given length. Each end of crossbar 24 has a vertical hole therethrough (not shown) of a diameter such that pin 38 can be received therein and thereby fixedly mount crossbar 24 to stanchions 20 and 22.

Although frame 12 is depicted as being a stand alone support and having an inverted U-shape, in other embodiments it can simply have an L-shape or a T-shape. In still other embodiments, it can simply be an eye-bolt that has been screwed into the ceiling.

Figure 2:
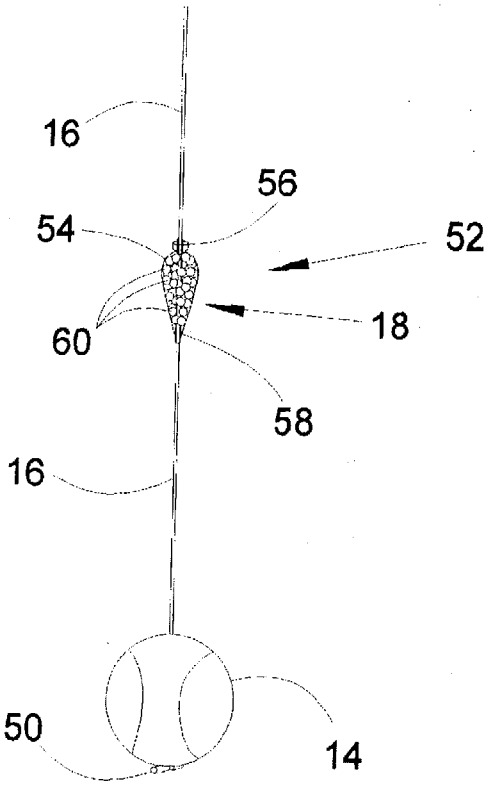
FIG. 2 is an enlarged perspective view of part of the device depicted in FIG. 1, but with the device being set up for a more experienced player.

With respect to FIG. 2, ball 14 is depicted in a larger size. Preferably, ball 14 is of a relatively small size, spherical and resilient. In FIG. 2, ball 14 is a tennis ball that has opposing holes in the top and bottom thereof (not shown) to receive and pass line 16 therethrough. Alternatively, ball 14 can be a racquetball ball, a squash ball, or even a shuttlecock. Also, ball 14 can be relatively rigid like a baseball or softball. In still other embodiments, ball 14 can be a larger sized, resilient ball such as a soccer ball or a volleyball. In these latter examples, the ball can be hit by a baseball bat or by the hand of the player. Nominally in tennis, line 16 is four feet. Line 16 is preferable a monofilament, plastic line, such as commercially available 80 pound fishing line. Line 16 passes through the opposed holes in ball 16 and is terminated by an enlarged plug 50 so that it cannot be pulled back out of ball 16. Alternatively, line 16 can be of any string material, woven or single strand. However, line 16 should be substantially non-elastic or non-resilient so that the level of chaos can be reasonably controlled and more predictable. By substantially nonelastic it is meant that under normal play, line 16 will not stretch and then return to its prior size. However, certain nylon lines or woven, multi-strand lines, such as the lines used to moor a ship, can stretch if large forces are applied thereto, but an average human could not stretch it.

Weight 18 can be best seen by referring to FIG. 2. In the preferred embodiment, weight 18 is a commercially available, transparent plastic fishing float that comprises a hollow, funnel shaped housing 52 that includes a lower body 54 and an upper top 56. Weight 18 has a hollow resilient tube 58 extending completely through weight housing 52. Tube 58 is fixedly attached at its respective ends to the bottom of body 54 and to upper top 56. Thus, top 56 is resiliently held on top of body 54. Line 16 passes completely through tube 58 and thus completely through weight 18. The frictional engagement between line 16 and the inner surface of tube 58 holds weight 18 in place on line 16, yet also is weak enough to be overcome by average human applied force. In this way, weight 18 can be positioned near the top of line 16 as shown in FIG. 1, which location is used for novices, or it can be positioned closer to ball 14 as shown in FIG. 2, which location is used for more advanced players.

Housing top 56 can be displaced from lower body 54, thereby giving access to the interior of housing 52. In a preferred embodiment, weights are placed inside lower body 54. These weights can simply be number twenty lead or steel shot 60. The preferred amount of charge of shot 60 when ball 14 is a tennis ball about two ounces is about one-half ounce. As weight 18 is increased the level of chaos is increased. Nominally, the maximum of weight 18 is 70% of that of ball 14.

To prepare device 10 for use, line 16 and attached ball 14 and weight 18 are attached to frame 12 such that ball 14 hangs down freely under the force of gravity. Weight 18, which is a movable weight that can slide the entire length of the suspension means, line 16, from ball 14 to the point of attachment on frame 12 is then positioned depending upon the experience and skill of the player.

Figure 3:
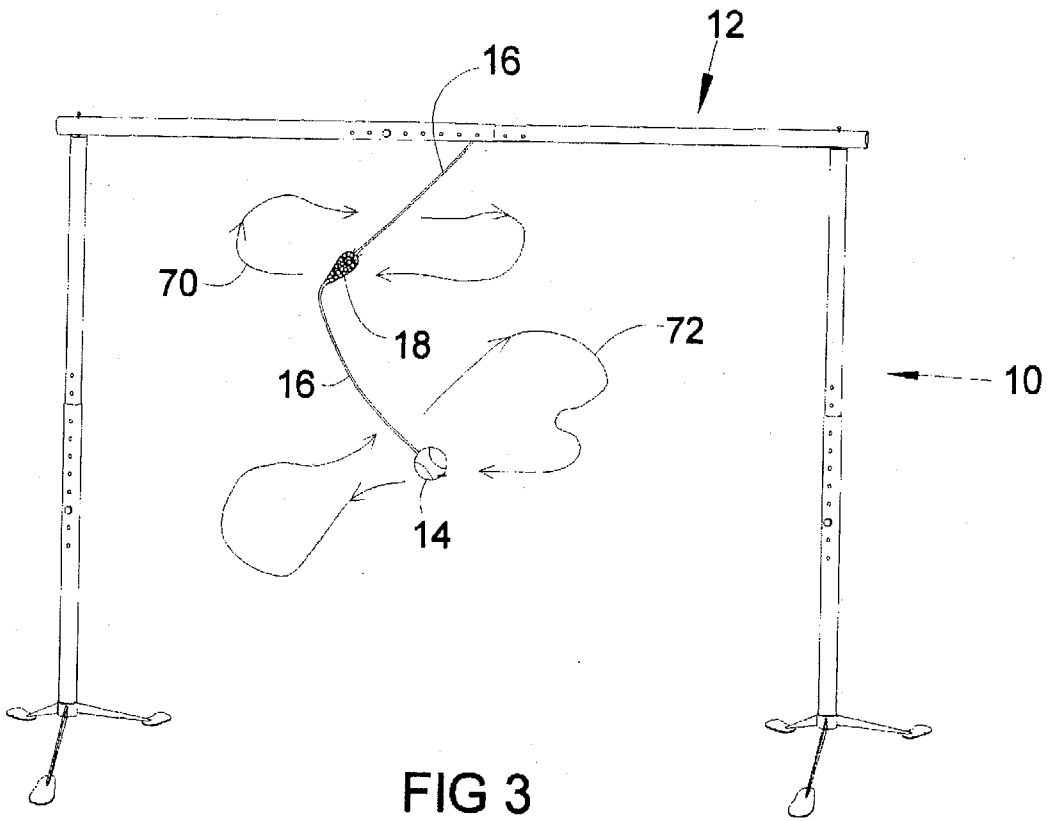
FIG. 3 is a schematic representation illustrating a typical path of a tethered ball when struck by a firm implement such as a racket.

In use, a player would typically pull the ball forward and then strike the ball by alternately swinging a firm implement in one direction and then in the opposite direction. As indicated in FIG. 3, the path the ball follows is chaotic. Weight 18, forming the top pendulum suspended from frame 12, will follow an exemplary path such as path 70. Ball 14, forming the bottom pendulum suspended from weight 18, will follow an entirely different path such as exemplary path 72. Volleying with chaotic moving ball 14 places increasing demands on a player's concentration, coordination, and visual processing when weight 18 is progressively moved from the point of suspension from frame 12 to a distance of about one foot above ball 14.

For novice players, it is important to start with weight 18 high above ball 14 since the difficulty of volleying a highly chaotic ball is such that the novice player can quickly become discouraged and give up on the training. As weight 18 is moved down toward ball 14, the degree of difficulty steadily increases until a point is reached where the player can progress no further. This is the point at which the training is completed. The player should periodically repeat the exercises to keep his or her visual processing and concentration in peak condition. In the highly chaotic training process where weight 18 is at least half the distance between ball 14 and point of suspension on frame 12, players have reported experiencing the "zone" state in which an exceptionally high level of play is possible.

While the training device described so far relates to a suspended ball to be struck, it is also within the scope of the invention to substitute a football for the ball 14. The trainee would, after the ball was placed in motion, attempt to catch the ball wherein motion of the ball simulates the motion of balls tipped by pass defenders. Thus using the device win greatly simplify the training of receivers to catch such footballs.

The device could also be used for training boxers by substituting a punching bag for the bag 14. As the ball is struck it responds will a chaotic motion more challenging to hit a second time. Working with the chaos boxing trainer will be more realistic than conventional punching bags and thus will accelerate the development of boxing skis.

Figure 4:
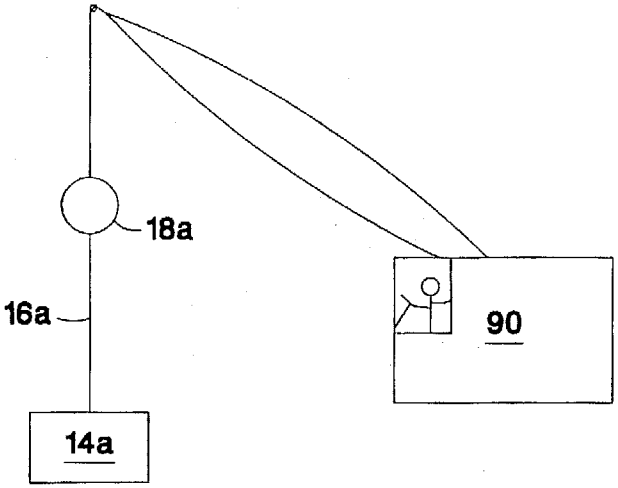
FIG. 4 is a schematic illustration of the application of the invention to training sea crane operators.

A sea crane trainer is illustrated in FIG. 4 and uses the same principles as the previously described trainers. The load 4*a* is placed into motion by pulling the load to one side and then releasing it so as to provide non-chaotic motion to the loci. The crane operator then practices bringing the loci under control. A movable weight 18*a* is attached to a crane line 16*a* above the load 1 The crane 90 is placed into motion by pulling the load 14*a* to one side and releasing it. The load 14*a* then responds with a chaotic motion. Now the crane operator attempts to remove the chaotic motion and bring the load 14*a* under control for a safe landing. Working with the chaos sea crane trainer will simulate the chaotic motion of crane operations on the high seas in critical sea states, thus developing the skills of crane operators to respond to the chaotic motions that occur in sea cargo transfers.

Figure 5:
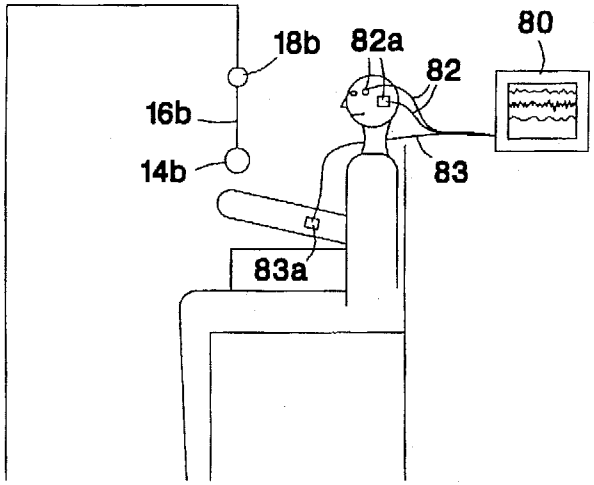
FIG. 5 illustrates the use of the invention in stimulating and recording brain activity.

A further application of the principles of the invention is illustrated in FIG. 5 A movable weight 18*b* is attached to a line 16*b* to which is attached a ball 14*b* exactly as is done in the above tennis trainer. In this embodiment an electroencephalograph (EEG) 80 is provided for recording brain wave activity which is stimulated by the trainees actions in response to the motion of ball 14*b*. The EEG 80 is connected to electrodes 82*a* attached to the head of the trainee by means of EEG leads 82 and another lead 83 connects the EEG to an arm electrode 83*a* attached to one of the arms of the trainee. A firm cover 84 is attached to the trainees arm to be used for striking the ball 14*b*. In operation the weight 18*b* is moved to the top of the line, removing all chaos and the ball 14*b* is placed in motion. The trainee then watches the ball without head movement. For a period of two minutes EEG recordings are made to form a baseline for an eye movement track. Next the weight 18*b* is moved down the line 16*b* to the mid-point and the previous steps are repeated to obtain a baseline chaotic eye movement track. Now the weight is returned to the top of the line, the ball is placed in motion and the trainee is asked to strike the bail 14*b* first in one direction and then the other. While the trainer is striking the ball for a period of two minutes EEG recordings are made from both the head and arm of the trainee to obtain a baseline arm and brain signal track for non-chaotic motion. Lastly file weight 18*b* is again lowered to the midpoint of the line 16*b* and the previous steps are repeated to obtain an EEG track for chaotic motion. The resulting EEG tracks allow researchers to determine how different brains respond to chaotic stimulus. Of particular interest is file asymmetries between the left and right hemispheres of the brain.

In addition to a training device, device 10 can have several additional uses. For example, device 10 can be used to stimulate the visual processing chain of a player, thereby having potential medical applications. For example, device 10 can be used to stimulate improvements in patients with visual pathologies related to a slow visual frame rate. Also, device 10 can be used to evaluate individual skill in controlling chaotic processes. For example, the selection of a crane operator for a pitching, yawing and rolling naval vessel on the high seas can be aided by the skill shown in using device 10. In this way, training device 10 can provide a direct mechanism to test and improve skills needed in controlling chaotic situations. Also training device 10 can be used to study the change in brain states. For example, device 10 provides an instrument that will stimulate the brain functioning and the measured results can be used as a comparison with the measured results of a brain functioning under non chaotic stimulus.

A training device in accordance with the present invention has been described with respect to specific embodiments thereof. However, modifications, changes, adaptations and simplifications would be apparent to those skilled in the art.

I claim:

1. A method of training a sea crane operator to respond to the chaotic motions that occur in sea cargo transfers utilizing a conventional a crane having a crane line and a cargo load attached thereto, comprising the steps of:

positioning a movable weight on said crane line above said cargo, pulling the cargo load to one side and releasing it to place the load in non-chaotic motion, operating the crane controls in such a manner as to bring the load under control for a safe landing of the cargo, repositioning said weight to a point on said line which will cause movement of said cargo to be chaotic, and repeating the steps of positioning, pulling and releasing the cargo and operating the controls until a desired level of skill at controlling the cargo has been achieved.

2. A method of training utilizing a tethered ball suspended on a substantially non-extensible, flexible line and having a weight positionally mounted on said line between said ball and a suspended end thereof for causing said ball to move in a chaotic manner when struck; said method comprising the following steps:

adjusting the level of chaotic movement of the tethered ball by changing the position of said weight on said line;

repeatedly striking said ball until a desired level of proficiency at striking said ball has beam attained;

increasing the level of chaotic motion of said ball by lowering the position of said weight on said line to increase the difficulty of volleying said ball;

periodically repeating sait steps of adjusting and increasing until a desired of skill at striking said ball has been achieved.

3. A method of training utilizing a tethered load suspended on a substantially, non-extensible, flexible line and having a weight positionally mounted on said line between said load and a suspended end thereof for causing said load to move in a manner varying from non-chaotic movement to highly chaotic movement when placed into motion; said method comprising the following steps:

adjusting the level of chaotic movement of the tethered load by changing the position of said weight on said line;

repeatedly contacting said load until a desired level of proficiency at contacting said load has been attained;

increasing the level of chaotic motion of said load by lowering the position of said weight on said line to increase the difficulty of contacting said load;

periodically repeating said steps of adjusting and increasing until a desired level of skill at contacting said load has been achieved.

4. A method of using a tethered ball training device for stimulating brain activity in a subject and recording said stimulated brain activity; comprising the steps of:

setting the tethered ball into non-chaotic motion;

taking and recording EEG readings from the subject's head for a period of time while said subject follows said ball with eye movement only, the subject's head remaining stationary; thereby obtaining a baseline eye movement EEG track for non-chaotic motion;

setting the tethered ball into chaotic motion;

taking and recording EEG readings from the subject's head for a period of time while said subject follows the ball with eye movement only, the subject's head remaining stationary, thereby obtaining a baseline eye movement EEG track for chaotic motion;

setting the tethered ball into non-chaotic motion;

taking and recording EEG readings from the subject's head and arm for a period of time while said subject strikes the ball first in one direction and then the opposite direction thereby obtaining a baseline arm and brain EEG track for non-chaotic motion;

setting the ball into chaotic motion;

taking and recording EEG readings from said subject's head and arm for a period of time while said subject attempts to strike said ball, thereby obtaining an arm and brain EEG track for chaotic motion.

5. A tethered ball training device having chaotic motion, said training device comprising:

a stand;

a substantially non-extensible, flexible line connected at one end portion to said stand;

an object to be struck mounted at tho other end of said line; and a weight positionally mounted on said line at a plurality of selectable locations between said stand and said object; said weight comprising a funnel shaped housing having a hollow lower body, a top member disengageable from said lower body, a hollow resilient tube extending through said housing and frictionally engaging said flexible line permitting positional adjustment of said housing along said line, and a plurality of metal shot within said lower body, the number of shot and the position of said weight determining the level of chaotic motion.

* * * * *